United States Patent [19]

Pierrel

[11] 4,316,495

[45] Feb. 23, 1982

[54] METHOD AND INSTALLATION FOR CENTRIFUGAL CASTING

[75] Inventor: Michel Pierrel, Pont-a-Mousson, France

[73] Assignee: Pont-a-Mousson S.A., Nancy, France

[21] Appl. No.: 160,706

[22] Filed: Jun. 18, 1980

[30] Foreign Application Priority Data

Jun. 25, 1979 [FR] France ..... 79 16251

[51] Int. Cl.[3] ..... B22D 13/02; B22D 13/12

[52] U.S. Cl. ..... 164/457; 164/117; 164/155; 164/301

[58] Field of Search ..... 164/114, 136, 299–301, 164/457, 155, 117

[56] References Cited

U.S. PATENT DOCUMENTS 1,906,511 5/1933 Barr et al. ..... 164/299 X
3,056,179 10/1962 Lorang ..... 164/301 X

FOREIGN PATENT DOCUMENTS 54-1232 1/1979 Japan ..... 164/301
212931 7/1924 United Kingdom ..... 164/299

*Primary Examiner*—Robert D. Baldwin
*Assistant Examiner*—J. Reed Batten, Jr.
*Attorney, Agent, or Firm*—Sughrue, Mion, Zinn, Macpeak and Seas

[57] ABSTRACT

In a centrifugal casting apparatus, the rate of flow of molten iron poured into the mold is controlled by varying the inclination of the feed channel. In particular, at the end of the casting operation, the supply of liquid to the feed channel is cut off and the upstream end of the feed channel is progressively raised. This can be controlled automatically by a cast iron level detector adjacent the pouring spout. In this manner, localized thickness defects in a series of pipes can be corrected. Furthermore, pipes of constant thickness throughout their length can be provided without the need to vary the translational speed of the feed channel or vary the rate of pivoting of the ladle of molten liquid.

3 Claims, 10 Drawing Figures

METHOD AND INSTALLATION FOR CENTRIFUGAL CASTING

The present invention relates to the centrifugation of pipes or other tubular bodies of cast iron. It concerns more particularly the De Lavaud casting method in which molten cast iron is poured into a rotating mold by means of a feed channel supplied by a ladle of cast iron while providing a relative longitudinal movement between the feed channel and the mold, and in which the supply of molten cast iron to the feed channel is interrupted before the pouring spout of the feed channel reaches the outlet end of the mold.

As is well known in the art, the feed channel generally has the form of a gutter and is extended upstream by an enlarged receiving portion into which the ladle pours the molten cast iron. The channel can be of unitary construction or composed of a number of segments and made rigid by a support cradle. This cradle is optional when the channel is of unitary construction. The mold generally has one end formed with a casing and one end plain, the latter being nearest to the feed channel.

It is often necessary to vary the rate of flow of the molten iron poured into the mold. This is the case because in a given mold, when the output of the ladle is constant and the cast iron flows with a constant translational speed, certain irregularities in the thickness of the pipes occur always in the same spot. Furthermore, when the supply of molten iron to the feed channel is interrupted, it is necessary to avoid a reduction in the flow rate of molten iron entering the mold in order to obtain a constant and regular thickness of cast iron throughout the whole length of the mold.

To correct the flow rate of the molten iron entering the mold, in known methods, the translational speed of the channel relative to the mold is modified. This involves complicating the displacement control means. In addition, at the end of the casting, after interrupting the supply to the feed channel, this translation speed must be reduced which has the disadvantage of increasing the manufacturing time for a pipe. Alternatively, the flow rate of the molten iron poured into the mold can be varied by altering the rate of pivoting of the ladle, or more generally the rate of supply of the feed channel. If this is done, it leads to a relatively delicate and complicated control arrangement, the effect of which is delayed by the substantial length of the feed channel.

Furthermore, in the two cases cited above, at the end of the casting process, a residue of cast iron remains in the feed channel which solidifes in the form of a tongue. This must be removed before the next casing can take place and consumes unnecessary energy to remelt it.

The object of the invention is to provide a casting method of the above type which allows the flow rate of the molten iron poured into the mold to be varied in a simple and precise manner. According to the invention this variation is carried out by varying the inclination of the feed channel.

In particular, after having interrupted the supply of molten iron, the inclination of the feed channel is progressively increased to maintain the flow rate of the molten iron constant until the pouring spout exits from the mold. This allows the feed channel to be substantially completely emptied at each casting, which almost completely eliminates the disadvantages due to the cast iron residue referred to above.

The method according to the invention thus allows cast iron parts to be made of uniform thickness without the need to vary either the speed of translation of or the rate of supply of molten iron to the feed channel.

A further object of the invention is to provide a casting apparatus for a centrifugation machine adapted to put such a method into practice. This apparatus comprises an approximately horizontal cantilevered beam supporting a feed channel of approximately the same length. The feed channel is articulated to the beam in the region of its pouring spout and a jack is provided to raise the upstream end of the channel relative to the beam.

According to one embodiment, intended particularly for the manufacture of pipes having small or medium diameters, the invention provides a centrifugal casting installation for putting into practice the device defined above. This installation comprises a longitudinally fixed feed channel supplied by a ladle of molten iron, a centrifugation carriage which is movable relative to the feed channel and provided with means for supporting the channel, and a jack for varying the height of the upstream end of the feed channel.

The method of the invention lends itself to automatic control with the aid of a device for regulating the inclination of the feed channel by means of a jack. Such a device comprises a level detector adjacent the pouring spout of the feed channel which controls the supply of hydraulic fluid to the jack.

The invention will now be described in more detail, by way of example only, with reference to the accompanying drawings, in which.

Figure 2:
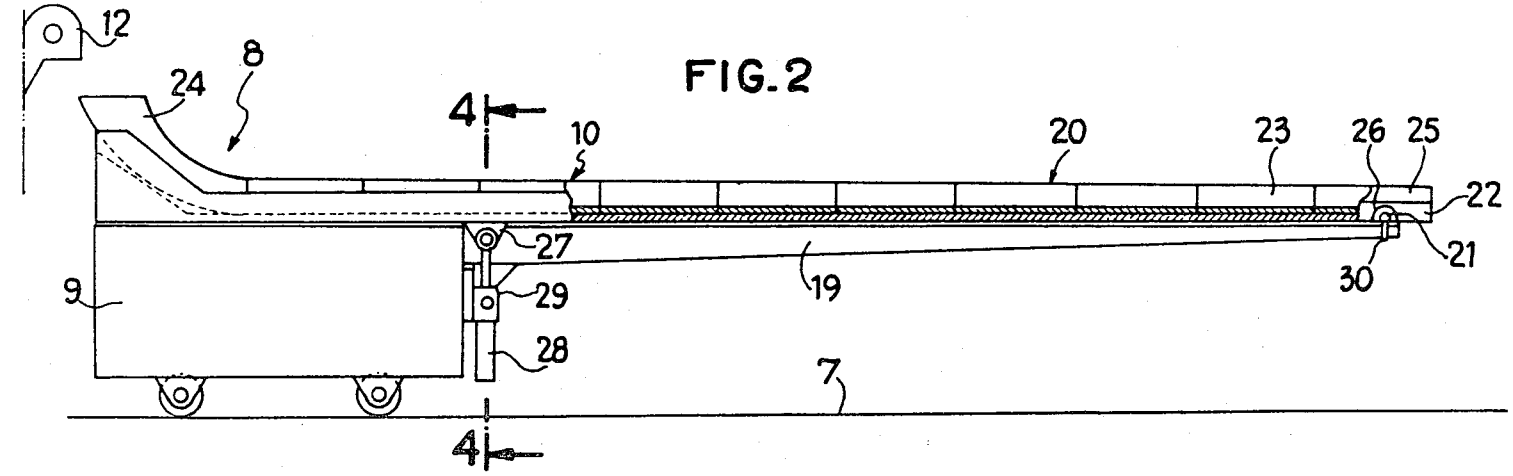
FIG. 2 is a similar diagrammatic view on a large scale of the casting device of this installation.
Figures 3, 4, 5, 6, 7:
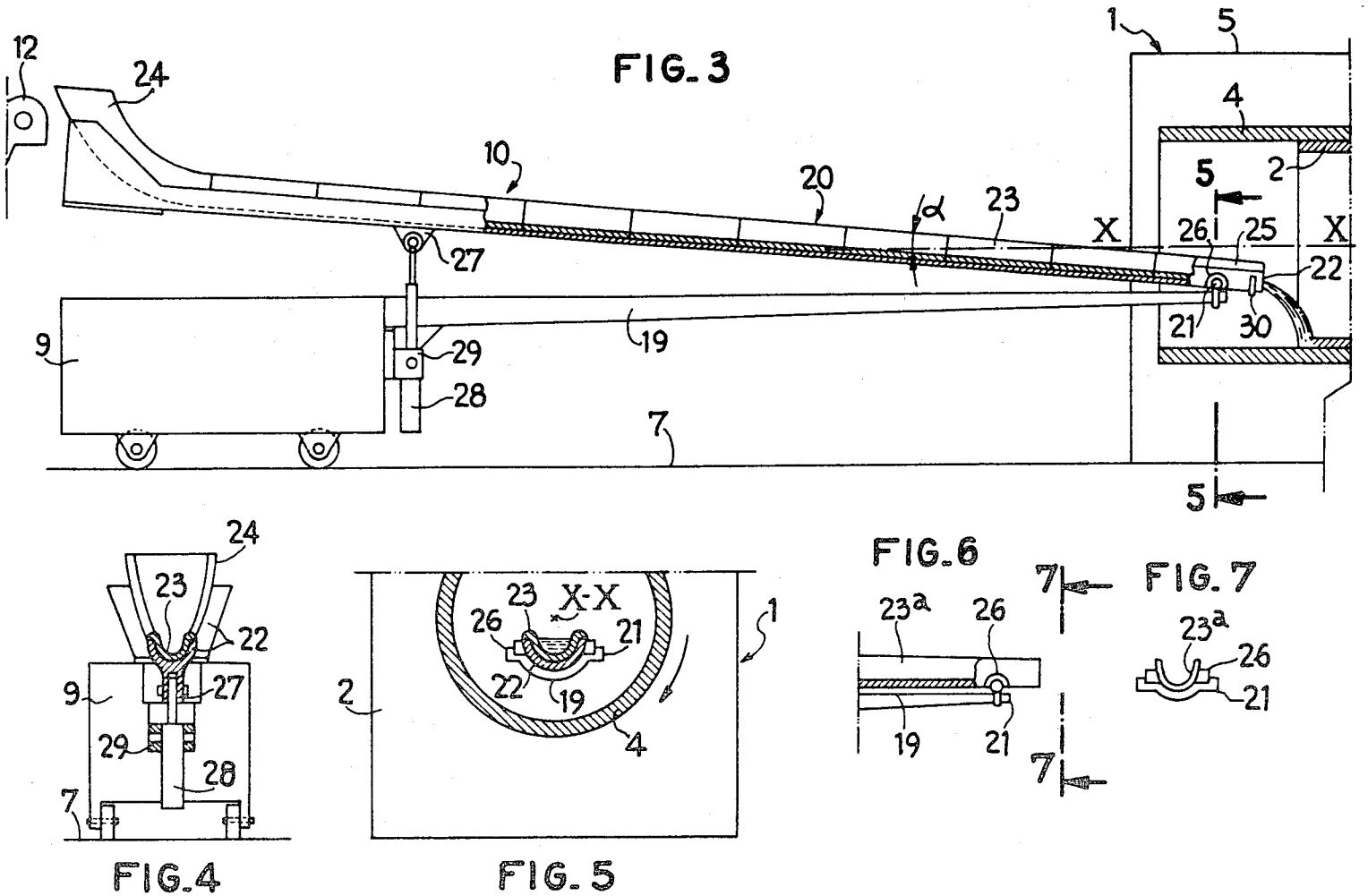
FIG. 3 is a view corresponding to FIG. 2 showing the channel in the raised position.
Figure 8:
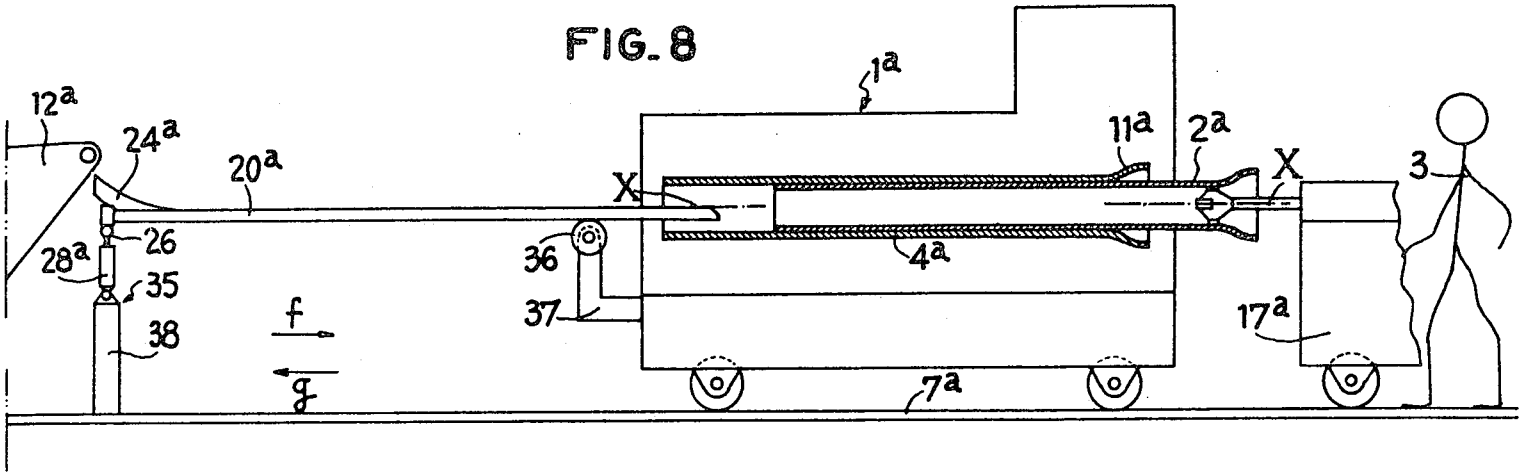
Figure 10:
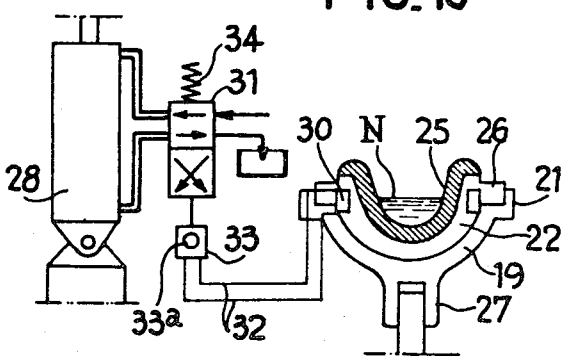
Figure 9:
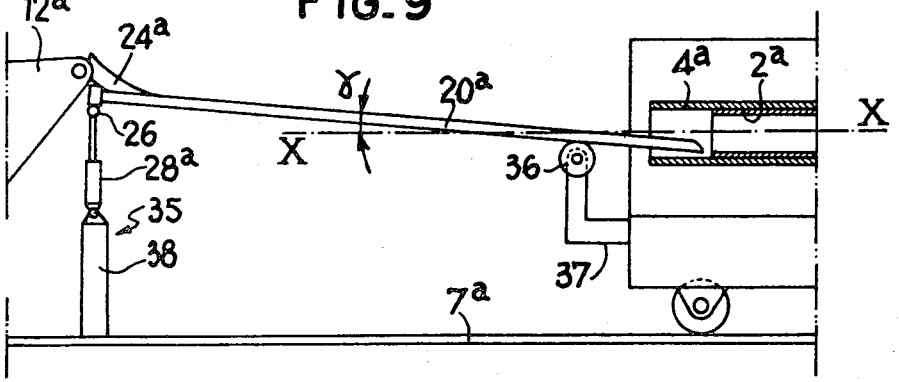

FIGS. 4 and 5 are respectively sectional views taken along the lines 4—4 of FIG. 2 and 5—5 of FIG. 3;

FIGS. 6 and 7 are partial views, respectively in side elevation with parts removed and in end view following the line 7—7 of FIG. 6, of a variant of the invention relating to a feed channel of unitary construction;

FIG. 8 is a diagrammatic view in side elevation and partial section of a centrifugation installation according to the invention for pipes of small or medium diameter;

FIG. 9 is a partial view similar to FIG. 8 showing the end of the casting process; and FIG. 10 shows diagrammatically a regulating device in accordance with the invention.

The centrifugation installation shown in FIGS. 1 to 5 comprises a centrifugation machine 1 for cast iron pipes 2 having an end casing and a diameter lying between, for example, 600 and 2,000 mm. These numerical values for the diameter are given solely by way of example and are not in any way intended to be limiting. In order to give an impression of the dimensions of the machine 1 and cast iron pipes 2, a human silhouette 3 is shown alongside the machine.

The machine 1 comprises essentially a rotary mold 4 having a substantially horizontal axis X—X accommodated in a housing 5 and carried on rollers 6, of which one is a drive roller. The rollers 6 are carried by a frame 7 fixed parallel to the axis X—X.

The mold 4 is supplied with molten iron by a casting device 8 which will be described in detail hereafter. This casting device comprises a carriage 9 which is movable in translation on the frame 7 parallel to the axis X—X so as to allow channel-beam assembly 10 to be introduced in the mold up to the end furthest from the latter and which is provided with a casing 11.

The casting device 8 is itself supplied with molten iron by a pivoting casting ladle 12, which is only partially shown, of which the pivotal axis is fixed.

In the extension of the housing 5, on the other side of the device 8, the installation comprises an extraction apparatus 13 consisting essentially of a roller track 14 parallel to the axis X—X and on which two support carriages 15 and 16 and an extractor carriage 17 travel, and a lifting device 18. The apparatus 13 can particularly be of the type described in French Pat. No. 74.23701.

The assembly 10 comprises a support beam 19 of large inertia and a composite channel 20. The beam 19 is fixed at its upstream end to the carriage 9 and is cantilevered towards the centrifugation machine 1. The free end of this beam is provided with two lateral cylindrical and horizontal lugs 21, perpendicular to the axis X—X and themselves lying along a common axis.

The channel 20 comprises a cradle 22 in which is formed the channel bed 23 which is provided at its upstream end with a hopper 24 and at its downstream end with a pouring spout 25 and which is composed of a certain number of successive segments. In a variant, the channel bed 23 can be of unitary construction.

The cradle 22 extends downstream up to the pouring spout 25. A little upstream of the latter, it is provided at its exterior with two lateral and part cylindrical semi-eyelets 26 respectively matching the upper part of the lugs 21 of the beam 19 and resting on the latter. Immediately downstream of the carriage 9, a clevis 27 projects under the cradle. A double-acting jack 28 is articulated between this clevis and another clevis 29 provided on the front of the carriage 9.

Figure 1:
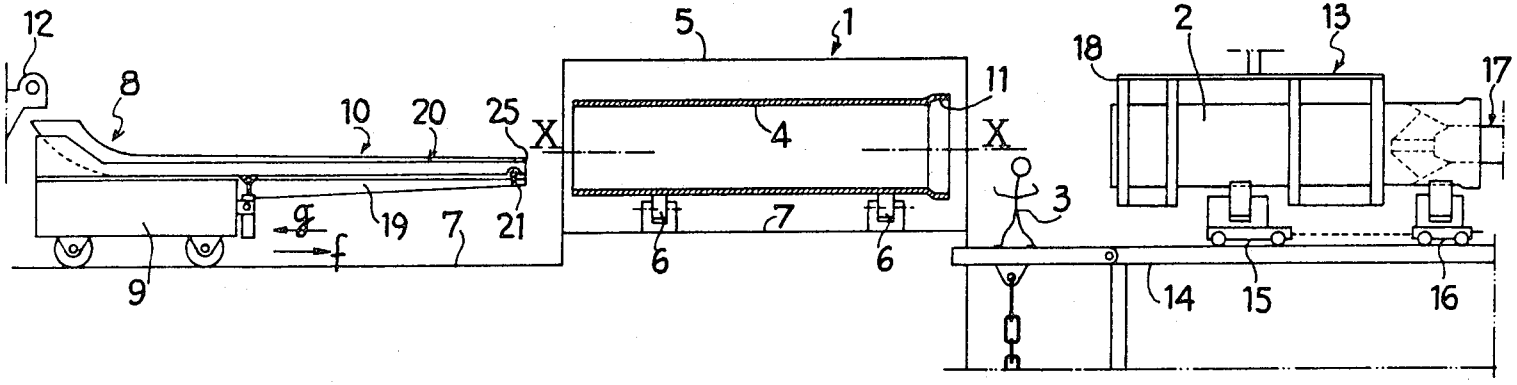
FIG. 1 is a diagrammatic view in side elevation and partial section, on a small scale, of an installation for casting pipes of large diameter provided with a casting device according to the invention.

Thus, the composite channel 20 is pivotally mounted about its downstream end between a low position which is substantially horizontal as shown in FIGS. 1 and 2 and a high position, in which it is inclined by an angle $\alpha$ to the horizontal, as shown in FIG. 3. These two extreme positions correspond respectively to the completely retracted and extended state of the jack 28.

The casting device 8 also comprises a flow rate regulating device shown diagrammatically in FIG. 10. This regulating device comprises a detector 30 of the level of molten iron in the region of the pouring spout 25 which is connected to a two-position slide valve distributor 31 controlling the supply of hydraulic fluid to the jack 28. The detector 30 is an inductor connected by electric wires 32 to a pilot electromagnet 33 acting on the slide valve of the distributor 31 against the action of a return spring 34.

The inductor 30 is mounted on the outside of the pouring spout of the channel and, consequently, out of direct contact with the molten iron. It comprises essentially a coil sensitive to the presence of molten iron at a given level N, below which it maintains a supply of electric current from the line 32 and above which it cuts the supply. In the first case, fluid under pressure is fed to the lower chamber of the jack 28 which causes the channel 20 to be inclined. In the second case, this fluid is fed to the upper chamber of the jack 28 to bring the channel 20 towards its low position. In each case, the chamber of the jack which is not supplied with fluid communicates with a fluid drain.

The pilot device 33 is also provided with a timing device 33*a* adapted to cut the supply of electric current when a predetermined time has passed.

The casting of a pipe 2 (FIGS. 1, 2 and 3) by means of this installation operates in the following manner.

Before casting, the carriage 9 is displaced in translation in the direction f until the pouring spout 25 of the channel 20 lies inside the casing end 11 of the mold 4 which is driven in rotation about the axis X—X. It is at this moment that the molten liquid is poured into the hopper 24 by the ladle 12 and that it starts to flow into the mold. The carriage 9 moves in translation in the opposite direction (arrow g) so that the pouring spout 25 travels the whole length of the mold until it exits by the plain end of the latter.

During this return movement, the inclination of the channel 20 can be varied by means of the jack 28 so as to vary or modulate the flow rate of molten iron poured from the spout 25 at any point in the mold. Thus, if a localized thickening or thinning of the centrifuged pipes is noticed at the same spot, this can be remedied by instantaneously increasing the inclination of the channel (for a thinning) instantaneously decreasing it (for a thickness) at the moment when the spout 25 reaches the point of the mold where the irregularity to be corrected occurs, and subsequently returning the channel to its normal inclination. This takes place while maintaining constant the rate of pivoting of the ladle 12 and the translational speed of the carriage 9. This correction does not involve the regulating device of FIG. 10.

It should be noted that this method of temporarily varying the amount of molten iron poured into the shell is made possible by the presence of the enlarged hopper 24 which, to a certain extent, acts as a variable capacity buffer between the ladle 12, which supplies the liquid at a constant rate, and the channel bed proper 23.

When the pouring spout of the channel 20 reaches a point in its travel situated near the end of the plain end of the mold 4, the supply of molten iron by the ladle 12 into the hopper 24 is stopped. Still without altering the translational speed of the carriage 9, the jack 28 is then again actuated so as to progressively increase the inclination of the channel 20 to deposit in the entire mold 4 a constant amount of molten iron, that is to say so that the flow rate at the pouring spout remains constant until the latter leaves the mold.

During this phase of casting, the channel 20 pivots about the two lugs 21 of the beam 19. The increase in the inclination of the channel 20 compensates for the lack of supply of molten iron upstream so that the same turns of molten liquid, in the same thickness, are deposited in the plain end of the rotating shell as before the interruption of the supply. It follows that the plain end of the centrifuged pipe is of the same thickness and has centrifugation turns of the same inclination as the main portion of the pipe, and that the quality of the pipe is therefore uniform right up to the plain end.

It will be readily understood that this increase in inclination can be controlled automatically by the device of FIG. 10 which is brought into operation after the interruption of the supply into the hopper 24 as soon as the level of molten iron falls in the region of the pouring spout 25.

When the spout 25 leaves the mold, the channel 20 is practically empty of molten iron. The jack is retracted, for example under the control of the timing device 33*a*.

to lower the channel 20 and return it to its normal low rest position with the cradle 22 on the support beam 19 for the next casting operation.

Since the translation speed of the carriage 9 is not slowed down at the end of the casting process, the manufacturing cycle is shortened and the control of the displacement of the carriage 9, which takes place at a constant speed throughout its travel, is simplified. Furthermore, during the casting, the slightest variation in the inclination of the channel is immediately converted into a corresponding precise variation in the flow rate of the molten iron poured into the mold.

The almost complete absence of solidified residue in the channel, in the form of a rod or tongue, after casting, allows considerable economies to be effected particularly concerning the consumption of molten iron, the fusion energy required, and the time necessary for removing the cast iron rod from the channel 20 and for maintaining the channel.

FIGS. 6 and 7 show a variant of the invention in which the channel bed 23 is of unitary construction and lacks a cradle support. In this case, the two half eyelets 26 are carried directly by the channel beds.

FIGS. 8 and 9 show the application of the invention to a centrifugal casting installation for casting iron pipes 2*a* of small or medium diameter, for example, from 200 to 600 mm. These figures are given purely by way of example, but, for reasons of size, it is difficult to drop much below a diameter of 200 mm. In order to appreciate the dimensions, the same human silhouette 3 shown previously is shown beside the centrifugation machine 1*a*.

As previously, the machine comprises a centrifugation mold 4*a* lying along an axis X—X which is slightly inclined to the horizontal. However, this machine comprises a centrifugation carriage 1*a* which is movable in translation along a track 7*a* parallel to the axis X—X.

In order to simplify matters, as shown in the example of FIGS. 1 to 5, the mold 4*a* is shown very diagrammatically without either its rotational drive system or its cooling system (which can be a water envelope or a water spray system), or its casing mandrel. Similarly, the carriage 1*a* is shown without its translational drive system.

In the extension of the carriage 1*a*, towards the end of the track 7*a*, is disposed a feed channel 20*a* provided at its upstream end with a hopper 24*a* supplied by a ladle of molten iron 12*a* pivoting about a fixed axis.

The channel 20*a*, presumed in this example to be of unitary construction and without support cradles, is supported at two points on its length, on the one hand upstream, near the hopper 24*a* by a support 35 and, on the other hand, downstream, at a variable point, by a support roller 36 having an axis which is horizontal and orthogonal to the axis X—X. This roller is carried by a support 37 outwardly projecting from the end faces of centrifugation carriage 1*a*.

The upstream support 35 of the feed channel is extendable. It comprises, above a frame 38, a jack 28*a*, the body of which is articulated to the frame and the piston rod of which is articulated to a clevis 26 integral with the upstream end of the channel 20*a*. The support roller 36 serves as a pivot for the channel. In the retracted position of the jack 28*a*, the channel 20*a* is in the normal low position with a small or zero inclination relative to the axis X—X of the centrifugation mold 4*a*. In the maximum extended position of the piston rod of the jack 28*a*, the channel 20*a* is in the high position and has its maximum inclination of angle $\gamma$ with respect to the axis X—X of the mold.

As can be seen, contrary to the previous example, it is the mold which is movable in translation and the feed channel which is fixed in translation.

On the other side of the machine relative to the channel 20*a* is shown diagrammatically an extractor carriage 17*a* in engagement with the pipe 2*a* during removal from the mold.

The operation of the installation of FIGS. 8 and 9 is similar to that of the preceding example. Assuming pipe 2*a* is to be cast, before the casting operation, the centrifugation carriage 1*a* is displaced in translation in the direction g until the spout of the feed channel 20*a*, which is in the low position, is located at the casing end 11*a* of the mold 4*a*. At this moment, the molten iron is poured into the channel 20*a* and starts to flow into the mold 4*a* which is driven in rotation. The centrifugation carriage 1*a* starts in translational movement in the opposite direction (arrow f) so that the channel 20*a* travels over the whole length of the mold.

During this translational movement and over the major part of the length of the mold, the channel 20*a* rests in its low position on the roller 36, which moves towards the pouring spout, and on the retracted jack 28*a*. When the pouring spout of the channel 20*a* reaches a point in its travel situated near the plain end of the mold, the supply of molten iron into the channel by the hopper 24*a* is stopped. Without altering the translational speed of the centrifugation carriage 1*a*, the jack 28*a* is actuated so as to raise the channel 20*a*, which pivots progressively about the roller 36 on which it rests (FIG. 9). The molten iron which is in the channel is then poured by the spout at a constant flow rate which is identical to the flow rate before the interruption of the supply in the hopper 24*a*. When the end of the spout of the channel 20*a* has left the plain end of the mold 4*a*, the channel is practically empty of molten iron. Then the channel 20*a* is lowered to its original position by actuating the jack 28*a*.

Similarly, the actuation of the jack 28*a* allows any localized variations of thickness noticed in a series of pipes 2*a* to be corrected. The advantage of this embodiment is thus the same as in the previous embodiment.

In another variant, a feed channel which is made rigid and supported by a cradle can be used in the installation of FIGS. 8 and 9. In this case, the cradle is itself articulated by two half eyelets on a support beam as is the case in the example of FIGS. 1 to 5. This beam is fixed and rests upstream on the frame 38, where it carries the jack 28*a*, and downstream on the roller 36.

The embodiments of the invention in which an exclusive property or privilege is claimed are defined as follows:

1. A method for manufacturing a tubular body by centrifugation wherein molten iron is poured into a rotary mold via a feed channel, comprising the steps of:

(a) inserting a pouring spout end of the feed channel through the mold to a position proximate a remote end thereof, (b) establishing relative longitudinal movement between the feed channel and the mold in a direction to gradually withdraw the feed channel from the mold, (c) supplying the feed channel with molten iron at a constant rate during said relative longitudinal movement, (d) terminating the supply of molten iron to the feed channel at a predetermined time before the pouring spout reaches a near, exit end of the mold, (e) progressively increasing the inclination of the feed channel after said supply termination to maintain a constant flow rate of molten iron from the pouring spout and into the mold until the pouring spout leaves the mold, and to empty the feed channel, and (f) maintaining said relative longitudinal movement constant during steps (c), (d) and (e).

2. A method as defined in claim 1, wherein the feed channel is pivotally supported at an end proximate the pouring spout and means are provided for raising and lowering another, remote end of the feed channel to vary its inclination, and wherein the inclination of the feed channel is progressively increased by:

(a) sensing the level of molten iron in the feed channel proximate the pouring spout, and (b) controlling the raising means in response to the sensed level to maintain a constant, predetermined level.

3. A centrifugal casting installation with an apparatus for regulating the inclination of a longitudinally extending, molten metal casting feed channel, comprising: a liquid level sensor mounted adjacent a pouring spout end of the feed channel, a fluid pressure operated jack coupled between base means and an opposite end of the feed channel remote from the pouring spout end, means pivotally supporting the pouring spout end of the feed channel, and a fluid distributor responsive to said level sensor for controlling the supply of pressurized fluid to said jack to maintain a constant, predetermined level of molten metal in the feed channel at the pouring spout end thereof.

* * * * *